United States Patent [19]

von der Eltz

[11] 4,242,090

[45] Dec. 30, 1980

[54] PROCESS FOR THE CONTINUOUS DYEING OF TEXTILE WEBS OF CELLULOSE FIBERS WITH REACTIVE DYES

[75] Inventor: Hans-Ulrich von der Eltz, Frankfurt am Main, Fed. Rep. of Germany

[73] Assignee: Hoechst Aktiengesellschaft, Frankfurt am Main, Fed. Rep. of Germany

[21] Appl. No.: 24,206

[22] Filed: Mar. 27, 1979

[30] Foreign Application Priority Data

Mar. 29, 1978 [DE] Fed. Rep. of Germany ..... 2813400

[51] Int. Cl.[3] ..... D06P 3/82; D06P 3/60

[52] U.S. Cl. ..... 8/532; 8/543

[58] Field of Search ..... 8/1 A, 54.2, 21 R, 21 C, 8/82

[56] References Cited

U.S. PATENT DOCUMENTS 4,184,842 1/1980 von der Eltz ..... 8/82

FOREIGN PATENT DOCUMENTS 2406257 8/1975 Fed. Rep. of Germany .

*Primary Examiner*—A. Lionel Clingman

*Attorney, Agent, or Firm*—Curtis, Morris & Safford

[57] ABSTRACT

Continuous dyeing of textile webs of cellulose fibers and of mixtures thereof with synthetic fibers using reactive dyes, by applying onto the textile material an aqueous solution of at least one reactive dye in conjunction with a mixture of fixation agents of a liquid alkali water glass having a density from 37° to 60° Bé and an alkali hydroxide solution having a density from 30° to 45° Bé, introducing the treated material into a tank where it is heated and subjected to the action of humid heat of 81° to 95° C. for 5 to 180 seconds, removing it continuously from the tank and then terminating the dyestuff fixation by brief steaming or by a brief immersion into a hot sodium silicate solution.

4 Claims, No Drawings

PROCESS FOR THE CONTINUOUS DYEING OF TEXTILE WEBS OF CELLULOSE FIBERS WITH REACTIVE DYES

The present invention relates to a process for the continuous dyeing of textile webs of cellulose fibers or of mixtures thereof with synthetic fibers using reactive dyes by applying onto the textile material an aqueous solution of at least one reactive dye in conjunction with a mixture of fixation agents of a liquid alkali water glass having a density from 37° to 60° Bé and an alkali hydroxide solution having a density from 30° to 45° Bé, introducing the treated material into a tank, where it is subjected to the action of humid heat, removing it continuously from the tank and then terminating the dyestuff fixation by brief steaming or by a brief immersion into a hot sodium silicate solution. German Pat. No. 24,06,257 discloses an analogous process, in which the ratio between alkali water glass and alkali hydroxide solution in the mixture of fixation agents employed is from 1:0.2 to 1:0.4. According to this known process the dwelling process in the tank takes place at a temperature from 20° to 80° C., these temperatures requiring fixation times from 5 to 30 minutes. During fixation the textile material is passed through the tank in a plaited down state.

Owing to the fact that the capacity of the tanks used as dwelling chambers was limited there was the need to shorten substantially the dwelling process without encountering losses in yield. Hitherto, however, a lower color yield could be observed whenever the dyestuff was fixed only by steaming without a previous dwelling operation. Moreover, it was desirable to get less expenditure on apparatus.

The present invention, consequently, provides a process for the continuous dyeing of textile webs of cellulose fibers with reactive dyes, which comprises heating the textile material after application of the reactive dye in conjunction with the liquor containing the mixture of fixation agents in a tank and keeping the batch in the tank at a temperature from 81° to 95° C. for a period from 5 to 180 seconds.

It has proved advantageous to modify the weight ratios of both components in the mixture of fixation agents. Thus a ratio from 1:0.05 to 1:0.25 between alkali water glass and alkali hydroxide solution was found to be advantageous according to the invention.

Hence the present invention makes it possible to shorten considerably the dwelling time, while achieving a complete dyestuff yield. Another advantage is that a substantially smaller tank suffices for this operation. The temperature in the tank, where the textile material is heated to 81° to 95° C., is controlled by means of infrared radiators, optionally with simultaneous steam injection. A reduction of the dimension of the tank implies less costs not only for the material but also for the energy. The short dwelling time makes it furthermore possible to guide the textile webs during dwelling by mechanical means (over deflecting rolls) or in an almost tension-less state (deposited on a screen belt or in festoon manner). It is also possible to pass upon heating hot air or steam of any kind through the textile material deposited on a screen belt or on a perforated drum in flat or crushed manner.

The process of the invention is superior over the process of German Pat. No. 24,06,257 in that a very brief dwelling operation may be followed without difficulty by a second fixation, for example by steaming or as wet fixation, so that both steps may be combined to form a unit.

It is surprising and not to be expected at all that the brief dwelling times according to the present invention leads to color yields and other results equal in quality to those obtained with the relatively long dwelling times of German Pat. No. 24,06,257. Nevertheless, the mixture of water glass and alkali hydroxide solution remains insensitive to variations in the steaming or wet fixation time and in the steaming and wet fixation temperature. It is not absolutely necessary to operate in a steamer free from air. A prolonged dwelling time does not affect the dyestuff fixation, either.

The process is suitable for fabrics made of cellulose fibers and of mixtures thereof with synthetic fibers and for knitwear, tubular goods, terry, velour and velvet goods.

The process of the invention may be used with the same good success for the dyeing of polyester-cellulose fiber blends. In this process the polyester fibers are dyed first with dispersion dyes according to the thermosol process and then the cellulose fibers are dyed according to the process of the invention. When using hydrolysis-resistent reactive dyes, the cellulose fiber may likewise be dyed first. During the stay in the dwelling chamber, during washing and during the subsequent thermofixation bulkiness may occur in each case with a suitable fiber material. Alternatively, the polyester fiber may be dyed subsequently on a jet dyeing apparatus.

Suitable reactive dyes for the process of the invention are the organic dyestuffs known under this designation. These dyestuffs are mainly those containing at least one group capable of reacting with polyhydroxyl fibers, a precursor thereof or a substituent capable of reacting with the polyhydroxyl fiber. Basic components of the organic dyestuffs are in particular those of the series of the azo, anthraquinone and phthalocyanine dyestuffs, the azo and phthalocyanine dyestuffs being free from metals or containing metals. Suitable reactive groups and precursors thereof which may form such reactive groups in an alkaline medium are, for example, epoxy groups, the ethylene imide group, the vinyl group in the vinylsulfonic acid or in the acrylic acid radical, the β-sulfatoethylsulfone or the β-chloroethylsulfone group. Moreover, there may be used derivatives of the tetrafluorocyclobutyl series, for example of the tetrafluorocyclobutylacrylic acid. Suitable reactive substituents in the reactive dyes are those that are easy to split and that contain an electrophilic radical. For example, halogen atoms on the following ring systems may be used: quinoxaline, triazine, pyrimidine, phthalazine and pyridazone. Dyestuffs containing several groups of different kind may also be used.

The alkali hydroxide solutions required for the fixation may be used in the amounts that are customary for dyeing with reactive dyes, in most cases, for example, in an amount from about 5 to 90 g per liter of padding liquor. Suitable alkaline compounds of this type are, for example, sodium hydroxide or potassium hydroxide, corresponding to an alkaline density from 30° to 45° Bé.

Among the liquid alkali water glasses that are added to the padding liquors according to the invention, in particular commerical sodium silicates may be used. Sodium silicates having a density from about 37° to about 60° Bé, corresponding to a $SiO_2$ content of the aqueous solution of about 27.2 to about 38.3 weight %, are used preferably. The feed quantity depends on the density of the alkali water glass used, on the dyestuff concentration and on the nature of the dyestuff and is in general in the range from about 25 to 350 g, preferably from about 50 to 200 g, per liter of padding liquor.

The steaming process which is performed upon the dwelling operation according to the invention, takes place at a temperature from 103° to 105° C. for 10 to 120 seconds. When the dwelling operation is followed by a wet fixation process, the latter is carried out at a temperature from 81° to 95° C. for 5 to 20 seconds.

The following examples illustrate the invention:

EXAMPLE 1

A bleached cotton fabric is padded with an aqueous liquor containing per liter 20 g of the dyestuff of the formula

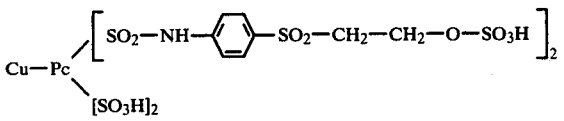

(Cu—Pc meaning copper phthalocyanine)

10 cm³/l of sodium hydroxide solution of 38° Bé (32.5 weight %) and 100 g/l of sodium silicate of 49° Bé, at a temperature of 30° C. and with a liquor take-up of 65%, calculated on the weight of the dry material. The textile material is left to stand for 2 minutes at 81° C., whereupon it is steamed for 60 seconds at 103° C.

After the usual aftertreatment of the coloration, the yield of fixed dyestuff obtained is practically the same as when fixation is carried out at room temperature (20° C.) for a period of 24 hours (=100).

The colorimetrical comparison of the tinctorial strength of both colorations showes a ratio of 100:106.

The measurements are carried out with a Hardy spectral photometer.

When carrying out steaming of the padded material immediately after the impregnation without a dwelling operation, a comparison between the yields gives a ratio of 100:71.

EXAMPLE 2

A rayon staple fiber fabric is impregnated with a liquor take-up of 70 weight % at 30° C. with an aqueous liquor containing per liter 20 g of the dyestuff of the formula

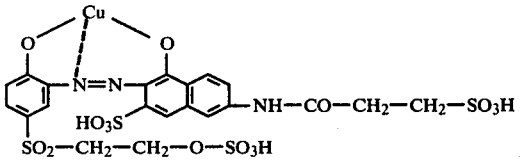

110 g/l of sodium silicate of 43° Bé and 20 cm³/l of sodium hydroxide solution of 38° Bé (32.5 weight %). Then the textile material is passed through an infrared zone, where it is heated to 90° C. It is left to stand at this temperature for about 30 seconds, whereupon it is steamed for 60 seconds at 103° to 105° C.

After the usual aftertreatment the color yield of the coloration is practically the same as that of a coloration (=100) prepared at room temperature with a dwelling time of 12 hours (100:101).

When omitting the dwelling operation at 90° C. of the padded material the yield obtained after steaming is only 100:77.

EXAMPLE 3

A fabric of mercerized cotton is padded with an aqueous liquor containing 20 g/l of the dyestuff of the formula

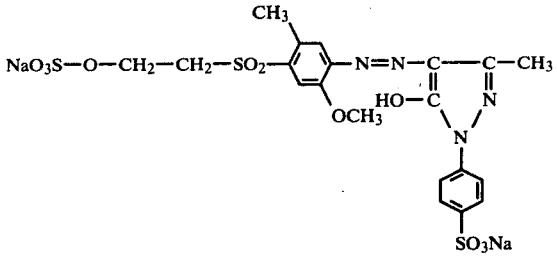

90 g/l of sodium silicate of 56° Bé and 20 cm³/l of sodium hydroxide solution of 38° Bé (32.5 weight %). Impregnation is carried out at 90° C. with a liquor take-up of 68% (calculated on the weight of the dry material).

A. A part of the coloration is left to stand at room temperature for 24 hours (=100).

B. Another part is steamed immediately at 103° C. for 30 to 60 seconds.

C. A third part of the coloration is treated immediately at 95° C. with a solution of 900 parts of sodium silicate of 49° Bé and 100 parts of sodium hydroxide solution of 38° Bé for 10 to 20 seconds.

D. A fourth part of the coloration is allowed to stand for 1 minute at 85° C. and is then subjected to steaming at 103° C. for 60, 120 and 180 seconds respectively.

All colorations are aftertreated in usual manner.

The following tinctorial strength comparisons are determined by colorimetry:

| | | |
|---|---|---|
| A = 100 | B 30 sec. = 70 | B 60 sec. = 69 |
| | C' 10 sec. = 71 | C 20 sec. = 90 |
| D 60 sec. = 103 | D 120 sec. = 104 | D 180 sec. = 96 |

It can be clearly seen from this example that after a brief dwelling time at 85° C. colorations of approximately the same tinctorial strength can also be obtained when steaming is carried out for a longer period of time.

EXAMPLE 4

A bleached cotton fabric is treated at 30° C. with a liquor take-up of 70 weight % with an aqueous liquor containing per liter 20 g of the dyestuff of the formula

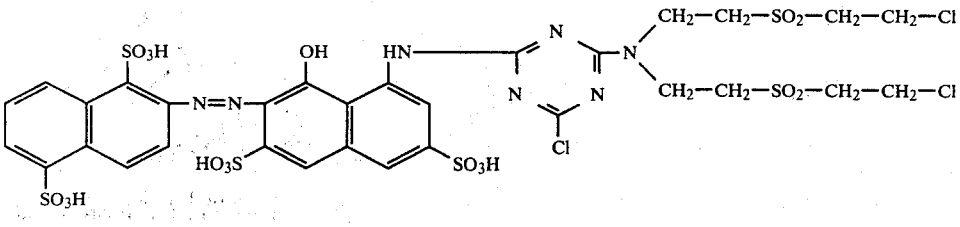

100 g of sodium silicate of 49° Bé and 10 cm³ of sodium hydroxide solution of 38° Bé (32.5 weight %).

A part of the padded material is left to stand at room temperature for 24 hours and is then finished in usual manner (A). Another part is left to stand for 1 minute at 85° C. and is then steamed for 120 seconds at 103° C. (B) or fixed for 15 seconds in a solution 95° C. hot of 90 parts of sodium silicate of 49° Bé and of 10 parts of sodium hydroxide solution of 38° Bé (C). By colorimetry the following comparison are found:

A=100 B=95 C=104

EXAMPLE 5

A bleached cotton fabric is treated at 20° C. with a liquor take-up of 62 weight % with an aqueous solution containing per liter 20 g of the dyestuff of the formula

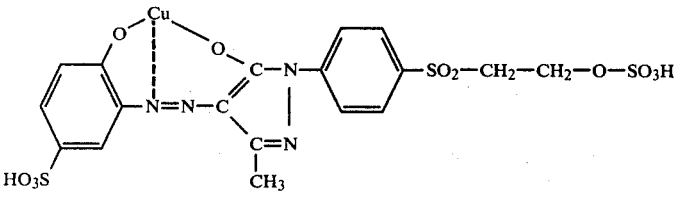

100 g of sodium silicate of 47° Bé and 5 cm³ of sodium hydroxide solution of 38° Bé (32.5 weight %).

The treated fabric is left to stand for 24 hours at room temperature, and the coloration is then compared with another coloration that has been left to stand in an infrared zone for 10 seconds at 90° C. and that has been steamed subsequently for 30 seconds at 103° to 105° C. A comparison of the tinctorial strength gives the ratio 100:103.

When steaming immediately after treating with the dyestuff solution the comparison of the tinctorial strength is 100:83.

EXAMPLE 6

A bleached cotton fabric is treated at 20° C. with a liquor take-up of 70 weight % with an aqueous solution per liter 20 g of the dyestuff of the formula

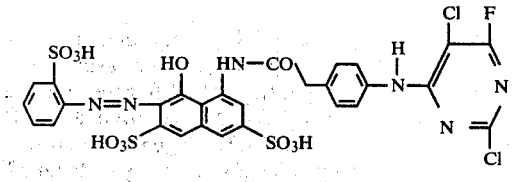

100 g of sodium silicate of 50° Bé and 10 cm³ of sodium hydroxide solution of 38° Bé (32.5 weight %).

Coloration A is obtained after having left the fabric to stand at room temperature for 24 hours.

Coloration B is steamed immediately after the impregnation at 103° C. for 60 seconds.

Coloration C is first left to stand for 60 seconds at 85° C. and is then steamed for 30 seconds at 103° C.

Coloration C is first left to stand for 30 seconds at a temperature of approximately 95° C. and is then fixed for 30 seconds at 95° C. in a solution of 90 parts of sodium silicate of 49° Bé and of 10 parts of sodium hydroxide solution of 38° Bé.

The yield comparisons determined colorimetrically are as follows:

A=100 B=57 C=100 D=102.

EXAMPLE 7

A bleached cotton fabric is padded at 30° C. with a liquor take-up of 65 weight % with an aqueous liquor containing per liter 20 g of the dyestuff of the formula

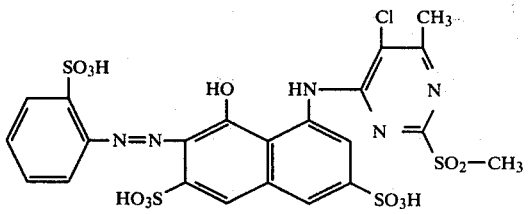

100 g of sodium silicate of 49° Bé and 10 cm³ of sodium hydroxide solution of 38° Bé (32.5 weight %).

When steaming the padded material immediately, i.e. without intermediate drying in the wet state, for 60 seconds at 103° C., the resulting coloration has only a poor tinctorial strength.

When leaving the padded material to stand at 95° C. for 60 seconds prior to steaming and when fixing the dyestuff subsequently by steaming for 60 seconds at 103° C., a very deep red coloration is obtained having a far greater tinctorial strength.

EXAMPLE 8

When carrying out the coloration in an analogous manner as described in Example 7, but with the use of the dyestuff of the formula

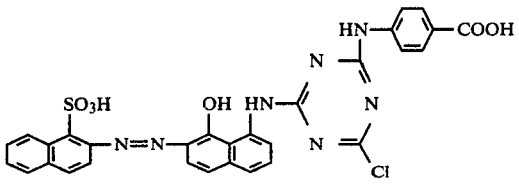

the resulting coloration is deeper when the padded material is left to stand for a certain period of time prior to steaming.

Similar results are obtained when using dyestuffs of the formulae

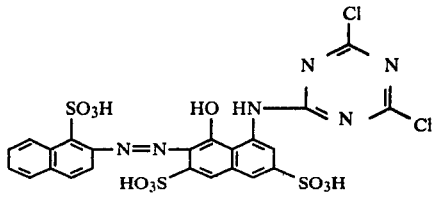

The yield evaluations determined colorimetrically are as follows:

A=100 B=74 C=104 D=95

What is claimed is:

1. In a process for the continuous dyeing of a web of

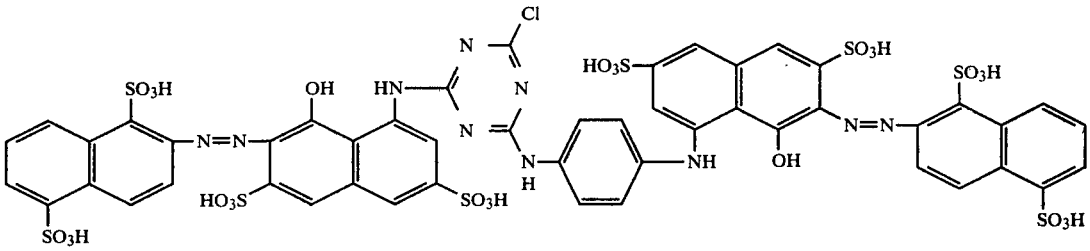

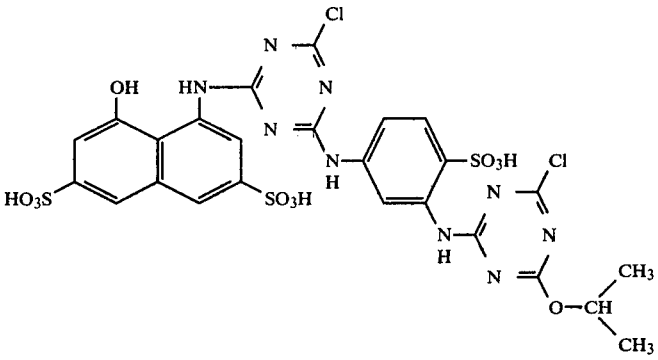

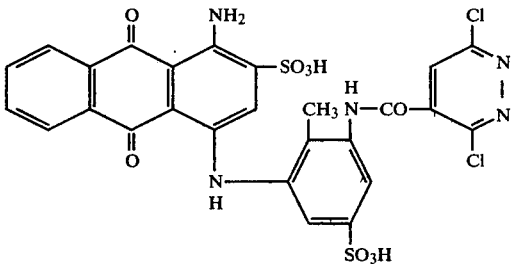

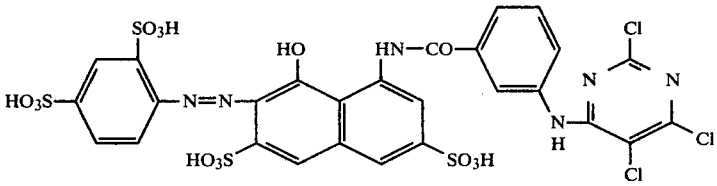

textile material made of cellulose fibers and of a mixture of cellulose fibers with synthetic fibers using reactive dyestuffs, by applying to the web of fibrous material an aqueous solution of at least one reactive dyestuff to which has been added, as fixation agents, a mixture of a liquid alkali water glass having a density of from 37° to 60° Bé and an alkali hydroxide solution having a density of from 30° to 45° Bé, introducing the treated material into a dwelling chamber where it is subjected in a cut-tled-up or opened-out condition to a high humidity

EXAMPLE 9

A bleached cotton fabric is dyed according to the prescription of Example 6, but with the use of 20 g/l of the dyestuff of the formula heating, removing it continuously from the dwelling chamber and then terminating dyestuff fixation by a brief steaming or by a brief immersion into a hot sodium silicate solution, the improvement of which comprises: heating the textile material in the dwelling chamber after application of the liquor containing the reactive dyestuff and the mixture of fixation agents, and leaving it to stand there at a temperature of from 81° to 95° C. for a period of from 5 to 180 seconds.

2. A process according to claim 1, wherein there has been added to the dye solution from 25 to 350 grams per liter of solution of liquid alkali water glass.

3. A process according to claim 1, wherein there has been added to the dye solution from 5 to 90 grams per liter of solution of alkali hydroxide solution.

4. A process according to claim 1, wherein the ratio of liquid alkali water glass to alkali hydroxide solution added to the dye solution is from 1:0.05 to 1:0.25.

* * * * *